US009772152B1

(12) United States Patent
Niccum

(10) Patent No.: US 9,772,152 B1
(45) Date of Patent: Sep. 26, 2017

(54) AMMUNITION STORAGE AND A MAGAZINE LOADING/ UNLOADING DEVICE FOR WEAPONS

(71) Applicant: Jeffery N Niccum, Pendleton, IN (US)

(72) Inventor: Jeffery N Niccum, Pendleton, IN (US)

( * ) Notice: Subject to any disclaimer, the term of this patent is extended or adjusted under 35 U.S.C. 154(b) by 0 days.

(21) Appl. No.: 15/268,599

(22) Filed: Sep. 18, 2016

(51) Int. Cl.
*F41A 9/83* (2006.01)
*F41A 9/65* (2006.01)
*F41A 9/82* (2006.01)

(52) U.S. Cl.
CPC . *F41A 9/65* (2013.01); *F41A 9/82* (2013.01)

(58) Field of Classification Search
CPC ..... F41A 9/82; F41A 9/83; F41A 9/84; F41A 9/65
USPC ..... 42/87, 88, 90
See application file for complete search history.

(56) References Cited

U.S. PATENT DOCUMENTS 1,245,499 A * 11/1917 Orme ..... F41A 9/67 124/52
2,514,277 A 7/1950 Donallan
4,464,855 A 8/1984 Musgrave
4,570,371 A 2/1986 Mears
4,574,511 A * 3/1986 Csongor ..... F41A 9/83 42/87
4,614,052 A 9/1986 Brown et al.
4,719,715 A * 1/1988 Howard ..... F41A 9/83 42/87
4,993,180 A 2/1991 Upchurch
5,249,386 A 10/1993 Switzer
5,377,436 A 1/1995 Switzer
6,817,134 B2 11/2004 Newman
7,805,874 B2 10/2010 Tal et al.
9,279,631 B2 * 3/2016 Barnhart ..... F41A 9/67
2014/0298704 A1 10/2014 Niccum
2015/0377573 A1 12/2015 Niccum

* cited by examiner

*Primary Examiner* — Reginald Tillman, Jr.
(74) *Attorney, Agent, or Firm* — John D Ritchison; Ritchison Law Offices, PC

(57) ABSTRACT

An ammunition storage and a magazine loading/unloading device for weapons. The apparatus provides for the rapid loading of ammunition into a magazine used for holding a number of rounds of ammunition. It is comprised of a loader body having a reservoir section, having a magwell section, and a connecting way to receive an ammunition magazine, and having a manner for connecting the magwell section to the reservoir section; an essentially rectangular block which slidably interfaces with the essentially rectangular inner space of the loader body and the rectangular block with an aperture for receiving a plunger handle; and a spring retaining clip to hold the ammunition in the inner space of the loader body. The device loader body can be a single or alternatively a two piece reservoir assembly and can be used as an unloading device as well.

10 Claims, 12 Drawing Sheets

60
65D
70
69
73A
61

65
70
69
73A
61
60

69
67
66
68
67A
69
65

69
67
68
66
67A
69
65

68
65
69
67
68
66
67A
69
65

72
73
73A
72A
71

72
73A
73
70

72
72A
73A
73
70

60
61
65
70
73A 65
66
67
68

65
66
67
67A
68
69
69
69
67

70
72
71
72
72A
73
70
72
72A
73
73A

90

90
91
92
91
92
91
92
92

Section E-E

Section J-J 30,31
56
55
57
58
59
75
76
80
80A
81
81A
81B
81C
81D
81E
82
74
74A
45
100
A
E
J 100
105
109
110
120
106
108
107

109
120
108
106

120
106
108
105

109
110
106
108

108
110
105
120

108
106
106

105
106
110
109
100

101
108
120
122
125
126
128

AMMUNITION STORAGE AND A MAGAZINE LOADING/ UNLOADING DEVICE FOR WEAPONS

CROSS-REFERENCE TO RELATED APPLICATIONS

None.

FIELD OF INVENTION

This invention is an ammunition storage and a magazine loading/unloading device for weapons. The present invention relates in general to a device or apparatus for storing ammunition, loading ammunition into a magazine, and unloading ammunition from a magazine. More particularly, the invention is concerned with a device or apparatus which provides for the storage and rapid loading of ammunition into a magazine used for holding a number of rounds of ammunition. In addition, the present invention relates to a magazine unloading system, and more particularly to a magazine unloader mechanism which can quickly and easily unload the ammunition directly into the device for storage. Therefore, the creation relates to firearm magazine loaders, unloaders and ammunition storage, particularly to a loader and method for loading loose rounds. Firearms, including short weapons, assault rifles, and submachine guns, utilize and fire rounds (also known as cartridges and ammunition).

Moreover, this invention relates to a cartridge loader and a cartridge unloader, more particularly, to a device for reloading cartridges into the magazine of such a firearm. This may also be called a magazine loading tool and/or cartridge loading device since it relates to a device for loading cartridges into a magazine of a firearm.

FEDERALLY SPONSORED RESEARCH

None.

SEQUENCE LISTING OR PROGRAM

None.

BACKGROUND

Field of Invention and Prior Art

As far as known, there is no ammunition storage and a magazine loading/unloading device for weapons or the like as shown here. It is believed that this product is unique in its design and technologies.

BACKGROUND

Ammunition magazines are the most common means of storing and delivering ammunition into firearms. Firearms, including short weapons, assault rifles, and submachine guns, utilize and fire rounds (also known as cartridges and ammunition). Each round is substantially elongated and comprises a deep cuplike case (also known as a shell case and sometimes also a cartridge), usually of brass, which is filled with an explosive propellant. Traditionally, when loading a cartridge magazine for a firearm, the cartridge (e.g. ammunition) must be manually loaded one at a time through an opening on a top portion of the cartridge magazine. Generally, each cartridge is pressed against a previously loaded shell and a magazine spring contained in the cartridge magazine is compressed. As each shell is inserted, strain on the fingers may increase which may cause the individual's hand to become tired and many individuals may not have the required strength or dexterity to manually load the cartridge magazine. Other individuals may only be able to partially load a cartridge magazine due to the increased strength and dexterity required to continue to load the magazine as the spring continues to be compressed. Alternatively, individuals who do have the required strength or dexterity to manually load a single cartridge into a magazine may not have the strength to manually load multiple cartridge magazines. Furthermore, resistance of the magazine spring can slow the speed at which a magazine is loaded.

Loading magazines with loose rounds is a relatively time-consuming, tedious, and painful practice if done with bare fingers. Pain accumulates and intensifies as more rounds are loaded against the increasing spring pressure, thus slowing the loading process. When a plurality of magazines are to be loaded, much time is required, which in turn shortens time for reposing, training, or combat time. In combat circumstances, slow reloading can be life-threatening.

The rounds are held within and fed into the firearm from a magazine. Detachable magazines have become dominant throughout the world. The term "magazine" is broad, encompassing several geometric variations, including curved magazines. Most detachable magazines are similar, varying in form and structure, rather than in their general principles of operation. Magazines usually take the form of an elongated container having a generally rectangular cross-section, which is attached to the underside of the firearm. Magazines are commonly made of aluminum alloys, plastic, steel, or a combination. They are usually closed on four or five sides and open on a sixth, upwardly facing, top, side or end, and are substantially hollow. The top open side has a rectangular opening and includes two round-retaining members, known as feed lips that project into or partly close the opening. An internal spring urges a follower or pusher (a shaped piece of plastic or metal) toward the open side. The follower in turn urges the rounds as a group up against the lips. The lips act as a stop for the rounds so that they are not expelled from the magazine. Within the magazine, the rounds are stacked or oriented in the magazine such that the longitudinal axes of the rounds are substantially parallel and perpendicular to the direction of travel of the spring and follower. Adjoining rounds are oriented somewhat side-by-side yet offset and in the same direction, i.e., the bullets of adjacent rounds are next to each other, as are the cases. Thus, the use of magazines is a convenient and effective method of feeding bullets, in rapid succession, into a weapon's firing chamber.

A. First Problem Solved—Reloading Ammunition Magazines:

On the other hand, as mentioned, the reloading of bullets into the spent magazine is known to be problematic. Thus a need is sought for a mechanism or device to be used and incorporated with the magazine so that the ammunition can be quickly and easily fed into the magazine. The loading of bullets into a magazine entails the progressive compression of the magazine spring. Initial loading may be accomplished without substantial manual effort while the latter stages of loading, by reason of increased spring resistance and internal friction, present a problem. Typically for magazines the bullet being loaded into the magazine is held by its nose and the base of the bullet used to depress the previously loaded bullet. Accordingly both substantial downward and inward pressure must be exerted on the bullet being loaded as it is slid into the magazine. Handling of the projectile portion of the cartridge can increase misfires and jamming. In addition to the manual dexterity required, a degree of finger strength is necessary. Still further, the unaided loading of magazines is a tedious, time consuming task which consumes costly time when accomplished at a busy firing range. More particularly, the structural design of the magazine requires each bullet to be individually loaded through the top ejection end of the magazine past the retainers and downwardly against the force of the magazine spring (typically a compression spring or equal) in order to receive the bullet within the magazine. As each bullet is loaded, in sequence, the magazine spring in the magazine becomes progressively compressed until the magazine is fully loaded with bullets. Naturally, the resistance of the magazine spring (force) against the downward force of loading the bullets into the magazine becomes greater with each successive bullet loaded into the magazine. Thus, for many years, bullets have been loaded into empty magazines of firearms by hand, using the fingers to force each bullet downwardly against the force of the compression spring and into captured arrangement within the magazine. This process is time consuming, and quite often frustrating, on cold days when a person's fingers are numb, or are enclosed in a glove or mitten.

B. Second Problem Solved—Ammunition Magazine Maintenance:

In many instances, a magazine is kept stored with ammunition for ready use. In order to conduct maintenance, the ammunition must be removed before the magazine can be disassembled safely. A second magazine is then usually loaded to substitute availability for the first magazine. In order to unload a magazine, the cartridges are removed one at a time. The process is repeated when reloading the magazine. The unloading and reloading is slow and tedious, and most users purchase new magazines instead of conducting the necessary maintenance on the current magazine. No means exist in the art to remove the spring itself before unloading the ammunition from a magazine. Likewise, no means exist to transfer ammunition directly from one magazine into storage in bulk.

C. Third Problem Solved—Unload Device and Ammunition Transfer:

With the traditional magazine loaders, many are complex and require many parts. Further, the said parts have difficult configurations and drafts making any plastic molding or metal forming a difficult and costly process due to expensive molds or forming equipment and due to difficult and multiple secondary assembly operations. Therefore a simple magazine loader is desired.

Aside from the present methods for unloading ammunition from a magazine for maintenance, there are no means for directly transferring ammunition to a storage media during maintenance and then from storage back into a magazine in bulk. [One notes that there are in fact magazine unloaders (lever or flange types) but these types basically just permit one to dump the rounds onto the table where the cartridges must be picked up and loaded back onto a stripper clip or placed into an ammunition box/can.] In the prior art, reloading ammunition stored in a storage media, such as ammunition boxes or carton racks, would require taking individual cartridges from either type of container and inserting them individually into a magazine. This is a time consuming and tedious process, but no effective and inexpensive manner or means exist for loading ammunition from a box or carton rack into a magazine in bulk. By using this built-in unloader mechanism with the ammunition storage and a magazine loading/unloading device for weapons, time to unload and load are both greatly reduced.

Prior Art

In the prior art are devices to assist loading of magazines, one such device being disclosed in U.S. Pat. No. 4,570,371 wherein a base is clamped to the upper end of the magazine where after a lever of the device rocks into engagement with and is used to depress the previously loaded bullet. Another device disclosed in U.S. Pat. No. 4,464,855 has a bullet engaging plate and an elongate base movable along the forward edge of the magazine. A spring biased pin engages an opening in the magazine front wall to hold the device against the action of the magazine spring. Such a device requires considerable effort to use with repeated engagement and disengagement from the magazine. Still other magazine loading devices serve to temporarily attach to the magazine with a hook component of the device holding a slidable magazine button fully depressed. As the bullets are loaded, they fall freely into the magazine with the risk of coming to rest askew in the magazine. Examples of these devices are found in U.S. Pat. Nos. 4,464,855; 4,488,371 and 2,514,277.

In order to increase loading speed and decrease finger pain, numerous magazine loaders have been designed. However, in the market there are many different magazines for firearms. They differ in their round capacity, length, width, depth, round caliber, materials, adaptability to match magazine wells, shape of lips, and magazine locking or latching mechanism. Often, each weapon has its own unique magazine. Therefore, to accommodate the extremely wide range of magazines with all their mechanical variations, manufacturers of magazine loaders had to manufacture the following loader types: 1. loaders of different fixed sizes basically described in U.S. Pat. No. 4,993,180 to Upchurch Feb. 19, 1991. 2. loaders with an integral user-adjustable mechanism to fit the loader to a particular magazine, such as loaders (U.S. Pat. Nos. 5,249,386 and 5,377,436 to Switzer, Oct. 5, 1993 and Jan. 3, 1995, respectively) sold under the trademark HKS. These have different overall sizes and a magazine length adjuster or fitter in each (HKS has ten different magazine loaders in the market for covering most of the magazines available); or 3. loaders with inserts or spacers to accommodate different magazine widths, such as the loader model #104 shown at www.worldwideordnance.com and sold under the trademark Cambi (U.S. Pat. No. 6,817,134 to Newman Nov. 16, 2004) having four separate insertable spacers.

Another U.S. Pat. No. 4,614,052 issued to Brown et al in 1986 and entitled "Firearm magazine and magazine loader" demonstrated a firearm magazines and magazine loaders for firearm cartridges include a channel-shaped container having a bottom wall of a width of more than one and less than two cartridge diameters, and side walls corresponding in height to a cartridge shell, and having an elongate open top extending between the side walls opposite and parallel to the closed bottom wall for receiving the cartridges so that each circular bottom of each cartridge is located at the closed bottom wall, so that the shell of each cartridge extends parallel to and is retained between the side walls, and so that the bullets of the cartridges are located at the open top. A lid for closure of the open top above the bullet is provided for retention of the cartridges in the channel-shaped container preparatory to a transfer of such retained cartridges through an opening out of the channel-shaped container with the aid of an actuated or biased cartridge seater. Finally, U.S. Pat. No. 7,805,874 issued to Tal et al in 2010 and entitled "Multi-round magazine loader and unloader" shows a firearm magazine loader for loading both rounds held by a stripper clip and for loading loose rounds into a magazine comprises, in one aspect, a stick-like body having a lower portion adapted to fit over and attach to an open top end of a magazine and an upper portion for receiving a loaded stripper clip or loose rounds. A tiltable and slideable slider is coupled inseparably to slots in the upper portion and slideable along it. Loading is achieved by using the slider to thrust down the top-most round in the upper portion, causing all other rounds below to be forced sequentially and quickly into the magazine. The loader also includes and unloading flange for unloading rounds from the magazine. Both the Brown and Tal are complex mechanisms and as disclosed fail to teach the device by Niccum with its fewer parts and simple engagement to ammunition magazines.

Niccum himself has prior applications for ammunition loaders and unloaders. In 2014, he had an application 20140298704 which portrayed a "Special Telescoping Magazine Ammunition Loader and Unloader". It taught a telescoping magazine ammunition loader/unloader for weapons loading and reserve ammunition storage. The apparatus provides for the rapid loading of ammunition into a magazine used for holding a number of rounds of ammunition. It is comprised of a top box, a bottom box sleeve a loading collar that surrounds an ammunition magazine; a means to telescope and retain the top box and bottom box within the inner area of the loading collar; and a removable plunger wherein the loader may retain at least one cartridge which may be forced into a magazine through the loading collar so an operator can quickly and efficiently reload the cartridge into the receiving magazine. Then in 2015, Niccum applied with a CIP application 20150377573, again entitled "Simple and Special Telescoping Magazine Ammunition Loader and Unloader" which showed a simplified telescoping device. Neither shows the simplified ammunition storage and a magazine loading/unloading device for weapons as portrayed within this instant device.

In summary, while there have been attempts to provide a mechanism for accepting a large range of different weapon magazines in a single magazine loader, none was able to do just that, and all are quite limited in the range of magazines they accept. As far as known, there is no ammunition storage and a magazine loading/unloading device for weapons such as demonstrated by Niccum.

SUMMARY OF THE INVENTION

This invention is an ammunition storage and a magazine loading/unloading device for weapons. Taught here are the ways an ammunition loader device may be placed safely and securely on an ammunition magazine and the used to quickly force and feed ammunition cartridges to load or reload a magazine for a firearms. Systems and methods for loading and unloading a magazine are comprised herein. The preferred apparatus described herein is an ammunition storage and a magazine loading/unloading device for weapons and the made of durable materials comprised of: a) a loader body having a reservoir section featuring an essentially rectangular inner space for receiving a series of ammunition rounds and a pair of slots, having a magwell section with an inner space and a connecting means to receive an ammunition magazine, and having a means for connecting the magwell section to the reservoir section; b) an essentially rectangular block which slidably interfaces with the essentially rectangular inner space of the loader body and the rectangular block with an aperture for receiving a plunger handle; c) the plunger handle with cross section to removably fit into the aperture of the rectangular block; and d) a spring retaining clip interposed into the pair of slots of the loader body to hold the ammunition in the inner space of the loader body wherein the ammunition storage and a magazine loading/unloading device provides a simple means for storing, loading and unloading ammunition to and from a magazine and wherein the device may retain at least one cartridge which may be forced into a magazine through the loader body so an operator can quickly and efficiently reload the cartridge into the receiving magazine. A similar but alternative embodiment is an ammunition storage and a magazine loading/unloading device for weapons and the made of durable materials comprised of: a) a separate reservoir section featuring an essentially rectangular inner space for receiving a series of ammunition rounds and a pair of slots; b) a separate magwell section with an inner space and a connecting means to receive an ammunition magazine; c) a means for attaching the magwell section to the reservoir section; d) an essentially rectangular block which slidably interfaces with the essentially rectangular inner space of the reservoir and the rectangular block with an aperture for receiving a plunger handle; e) the plunger handle with cross section to removably fit into the aperture of the rectangular block; and f) a spring retaining clip interposed into the pair of slots of the reservoir to hold the ammunition in the inner space of the reservoir wherein the ammunition storage and a magazine loading/unloading device provides a simple means for storing, loading and unloading ammunition from a magazine and wherein the device may retain at least one cartridge which may be forced into a magazine through the loader body so an operator can quickly and efficiently reload the cartridge into the receiving magazine.

OBJECTS AND ADVANTAGES

There are several objects and advantages of the ammunition storage and a magazine loading/unloading device for weapons. There are currently no known magazine loading devices that are effective at providing the objects of this invention. The ammunition storage and a magazine loading/unloading device for weapons has several objects and advantages:

Advantages and Benefits

| Item | Advantages |
|---|---|
| 1 | Permits a fast load of ammunition magazines |
| 2 | Is lightweight and portable |
| 3 | Meets or exceeds recent limits on ammunition magazine sizes |
| 4 | Provides an alternative to gun owners for ready-reloads for magazines |
| 5 | Is durable and can be made from readily available materials |
| 6 | Protects the cartridges from external forces while transporting and loading |
| 7 | Fewer Parts than traditional or former magazine loaders |
| 8 | Easier to produce by plastic molding or metal forming with less intricate configurations, corners and drafts; and fewer secondary assembly operations required - therefore less costly as the simple configuration |
| 9 | Interchangeable with most existing magazines but Will be caliber and mag design dependent |
| 10 | Quick couple with magazine via mag well |
| 11 | Curved reservoir- keeps cartridge casings flush to each other, round closest to magwell essentially |

-continued

| Advantages and Benefits | |
|---|---|
| Item | Advantages |
| | parallel to receiving magazine follower |
| 12 | Notch at bottom of plunger handle channel allows insertion of pin, clip, shim, etc. for loaded storage. |
| 13 | Magwell configured with an angled front stop to properly position unloading tab close to the lengthwise center of the magazine follower. Tabs on both sides allow magazine to be unloaded by moving from side to side. Rounds fall into reservoir, length of drop controlled by plunger position preventing over rotation. |

Accordingly, it is an object of the present invention to provide a device or apparatus for the rapid loading of a number of rounds of ammunition into a magazine. Another object of the present invention is to provide a rapid loading device as in accordance with the preceding object and in which the magazine can be loaded quite rapidly in under five seconds from storage; loading up to 15 additional rounds of ammunition with the current design. Still another object of the present invention is to provide an improved method of loading of a number of rounds of ammunition into a magazine, and in particular in which the method of loading is carried out rapidly.

Finally, other advantages and additional features of the present ammunition storage and a magazine loading/unloading device for weapons device will be more apparent from the accompanying drawings and from the full description of the device. For one skilled in the art of ammunition handling and loading devices, it is readily understood that the features shown in the examples with this product and device are readily adapted to other types of art of ammunition handling and loading systems and devices.

DESCRIPTION OF THE DRAWINGS

Figures

The accompanying drawings, which are incorporated in and constitute a part of this specification, illustrate an embodiment of the ammunition storage and a magazine loading/unloading device for weapons that is preferred. The drawings together with the summary description given above and a detailed description given below serve to explain the principles of the device. It is understood, however, that the ammunition storage and a magazine loading/unloading device for weapons is not limited to only the precise arrangements and instrumentalities shown.

FIGS. 4 C through 4 F are sketches of the plunger block. FIGS. 4 G though 4 I are sketches of the plunger handle.

FIGS. 7 E and 7 F are typical magazines.

FIG. 11 G through 11 J are sketches of a typical rifle round of ammunition, as an illustration.

DESCRIPTION OF THE DRAWINGS

Reference Numerals

Figure 1B:
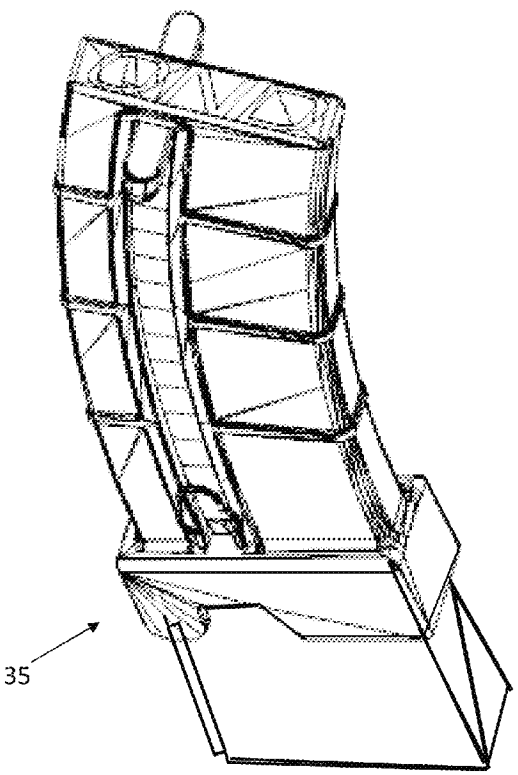
FIGS. 1 A and 1 B are sketches of the general magazine loader and magazine for holding ammunition device.

The following list refers to the drawings: Reference numbers

| Ref # | Description |
|---|---|
| 30 | general ammunition storage and a magazine loading/unloading device 30 for weapons comprised of a loader body 40, plunger assembly 60 and retaining clip 90 |
| 31 | solid surface 31 general magazine loader device 30 |
| 33 | cross section 33 of general magazine loader device 30, 31 |
| 35 | assembly 35 of general, magazine loader device 30 and magazine 100 |
| 40 | loader body 40 of magazine loader device 30, 31 |
| 41 | solid sketch 41 of loader body 40 |
| 43 | cross section 43 of loader body 40 |
| 44 | magwell 44/ magazine 100 interlocking or match up section of loader body 40 |
| 44A | inside surface 44A of magwell 44 - essentially a rectangular opening for the magwell 44 to have a contiguous opening with the reservoir space 53A |
| 44B | junction 44B of reservoir 53 and magwell 44 |
| 45 | aperture/ slot/ opening 45 in magwell 44 to accept magazine 100, 101 |
| 46 | solid end 46 of magwell 44 |
| 46A | outer surface 46A of solid end 46 |
| 46B | inner surface 46B of solid end 46 |
| 47 | ejection opening 47 opposite to solid end 46 in magwell 44 |
| 48 | pair of sides 48 of magwell 44 each with opposite slots 45 |
| 49 | bottom opening 49 of an essentially rectangular magwell 44 |
| 50 | convex end outer surface 50 of loader body 40, 41 |
| 50A | convex end inner surface 50A of loader body 40, 41 |
| 51 | concave end outer surface 51 of loader body 40, 41 |
| 51A | concave end inner surface 51A of loader body 40, 41 |
| 52 | structural ribs 52 for strengthening loader body 40, 41 |
| 53 | reservoir section 53 of loader body 40 |
| 53A | inner space 53A of reservoir section 53 for accepting ammunition 120 - essentially a rectangular space surrounded by the sides and ends of the reservoir 53 permitting the ammunition 120 to be stored or to pass through the reservoir into the magwell section 44 |
| 54 | right side 54 of loader body 40, 41 with aperture 55 |
| 54A | left side 54A of loader body 40, 41 with aperture 55 |
| 55 | aperture /slot/opening 55 for plunger assembly 60 handle 70 |
| 56 | top 56 of loader body 40 |

-continued

| Ref # | Description |
|---|---|
| 56A | outer surface 56A of top 56 of loader body 40 |
| 56B | inner surface 56B of top 56 of loader body 40 |
| 57 | rim end 57 magwell 44 and extension 74 |
| 58 | projectile end 58 of magwell 44 and extension 74 |
| 59 | angle 59 of magwell rim approximately 30 degrees from the end of the magwell 44, 74 |
| 60 | plunger assembly 60 with block 65 and handle 70 |
| 61 | engagement point 61 where handle 70 intersects block 65 at aperture 66 |
| 65 | plunger block 65 of plunger assembly 60 |
| 66 | opening / aperture 66 for handle 70 |
| 67 | top surface 67 of block 65 |
| 67A | bottom surface 67A of block 65 |
| 68 | web 68 of block 65 |
| 69 | a pair of end surfaces 69 of block 65 |
| 70 | plunger handle 70 of plunger assembly 60 |
| 71 | cross section 71 "I" or equal |
| 72 | top surface 72 of "I" 71 |
| 72A | bottom surface 72A of "I" 71 |
| 73 | web 73 of handle 70 |
| 73A | locking tabs 73A on web 73 of plunger handle 70 |
| 74 | magwell collar or extension 74 |
| 74A | taper 74A of magwell collar or extension 74 |
| 74B | inside surface 74B of magwell collar 74 - essentially a rectangular opening for the magwell collar 74 to have a contiguous opening with the separate reservoir space 80B |
| 75 | joint aperture 75 with separate reservoir 80 |
| 76 | notch 76 for magwell collar 74 |
| 80 | separate reservoir 80 |
| 80A | end taper 80A of reservoir 80 |
| 80B | inner space 80B of separate reservoir 80 for accepting ammunition 120 - essentially a rectangular space surrounded by the sides and ends of the separate reservoir 80 permitting the ammunition 120 to be stored or to pass through the separate reservoir 80 into the magwell collar 74 |
| 81 | bottom 81 of reservoir 80 |
| 81A | bottom taper 81A of separate reservoir 80 |
| 81B | side of taper 81B |
| 81C | outside width 81C of reservoir 80 |
| 81D | engagement taper 81D of separate reservoir 80 |
| 81E | outside width dimension 81E of magwell collar or extension 74 |
| 82 | mating angle 82 approximately 45 degrees |
| 90 | spring retaining clip 90 or equal |
| 91 | essentially horizontal engagement protrusion 91 of clip 90 |
| 92 | essentially vertical handle 92 of clip 90 |
| 93 | spring configuration 93 of clip 90 (inter connected arches, squares or the like of a wire or strip (metal, plastic, composite or the like) |
| 100 | magazine 100 line sketch |
| 101 | solid surface 101 magazine 100 |
| 105 | top opening 105 of magazine 100 |
| 106 | left and right hand sides 106 of magazine 100 |
| 107 | bottom 107 of magazine 100 |
| 108 | rim end 108 of magazine 100 |
| 109 | projectile end 109 of magazine 100 |
| 110 | aperture/ clearance/ slot 110 for ammunition 120 to exit magazine 100 |
| 120 | round 120 of ammunition |
| 125 | rim groove 128 of ammunition 120 |
| 126 | projectile (end) 126 of ammunition 120 |
| 128 | rim groove end 125 of ammunition 120 |
| | "R" rotation "R" of the magazine 100 and loader body 40 at opening 49 |
| α | an engagement angle a of approximately 15 to 30 degrees to the horizon |

DETAILED DESCRIPTION OF EMBODIMENTS

The present innovation is an ammunition storage and a magazine loading/unloading device for weapons. The present invention relates in general to a device or apparatus for storing ammunition, loading ammunition into a magazine, and unloading ammunition from a magazine. More particularly, the invention is concerned with a device or apparatus which provides for the storage and rapid loading of ammunition into a magazine used for holding a number of rounds of ammunition. In addition, the present invention relates to a magazine unloading system, and more particularly to a magazine unloader mechanism which can quickly and easily unload the ammunition directly into the device for storage.

Taught here are the ways that an ammunition loader device may be placed safely and securely on an ammunition magazine and the used to quickly force and feed ammunition cartridges to load or reload a magazine for a firearm.

The advantages for the special magazine ammunition loader device 31 are listed above in the advantages:

- Permits a fast load of ammunition magazines
- Is lightweight and portable
- Meets or exceeds recent limits on ammunition magazine sizes
- Provides an alternative to gun owners for ready-reloads for magazines
- Is durable and can be made from readily available materials
- Protects the cartridges from external forces while transporting and loading
- Fewer Parts than traditional or former magazine loaders
- Easier to produce by plastic molding or metal forming with less intricate configurations, corners and drafts; and fewer or no secondary assembly operations required—therefore less costly as the simple configuration
- Interchangeable with most existing magazines but will be caliber and mag design dependent
- Quick couple with magazine via mag well
- Curved reservoir—keeps cartridge casings flush to each other, round closest to magwell essentially parallel to receiving magazine follower
- Notch at bottom of plunger handle channel allows insertion of pin, clip, shim, etc. for loaded storage.
- Magwell configured with an angled front stop to properly position unloading tab close to the lengthwise center of the magazine follower. Tabs on both sides allow magazine to be unloaded by moving from side to side. Rounds fall into reservoir, length of drop controlled by plunger position preventing over rotation.

The preferred apparatus described herein is an ammunition storage and a magazine loading/unloading device for weapons and the made of durable materials comprised of: a) a loader body having a reservoir section featuring an essentially rectangular inner space for receiving a series of ammunition rounds and a pair of slots, having a magwell section with an inner space and a connecting means to receive an ammunition magazine, and having a means for connecting the magwell section to the reservoir section; b) an essentially rectangular block which slidably interfaces with the essentially rectangular inner space of the loader body and the rectangular block with an aperture for receiving a plunger handle; c) the plunger handle with cross section to removably fit into the aperture of the rectangular block; and d) a spring retaining clip interposed into the pair of slots of the loader body to hold the ammunition in the inner space of the loader body wherein the ammunition storage and a magazine loading/unloading device provides a simple means for storing, loading and unloading ammunition from a magazine and wherein the device may retain at least one cartridge which may be forced into a magazine through the loader body so an operator can quickly and efficiently reload the cartridge into the receiving magazine.

A similar but alternative embodiment is an ammunition storage and a magazine loading/unloading device for weapons and the made of durable materials comprised of: a) a separate reservoir section featuring an essentially rectangular inner space for receiving a series of ammunition rounds and a pair of slots; b) a separate magwell section with an inner space and a connecting means to receive an ammunition magazine; c) a means for attaching the magwell section to the reservoir section; d) an essentially rectangular block which slidably interfaces with the essentially rectangular inner space of the loader body and the rectangular block with an aperture for receiving a plunger handle; e) the plunger handle with cross section to removably fit into the aperture of the rectangular block; and f) a spring retaining clip interposed into the pair of slots of the loader body to hold the ammunition in the inner space of the loader body wherein the ammunition storage and a magazine loading/unloading device provides a simple means for storing, loading and unloading ammunition from a magazine and wherein the device may retain at least one cartridge which may be forced into a magazine through the loader body so an operator can quickly and efficiently reload the cartridge into the receiving magazine.

There is shown in FIGS. 1-12 a complete description and operative embodiment of the ammunition storage and a magazine loading/unloading device 30 for weapons. In the drawings and illustrations, one notes well that the FIGS. 1-12 demonstrate the general configuration and use of this product 30. The various example uses are in the operation and use section, below.

The accompanying drawings, which are incorporated in and constitute a part of this specification, illustrate an embodiment of an ammunition storage and a magazine loading/unloading device 30 for weapons that is preferred. The drawings together with the summary description given above and a detailed description given below serve to explain the principles of the ammunition storage and a magazine loading/unloading device 30 for weapons. It is understood, however, that the device 30 is not limited to only the precise arrangements and instrumentalities shown. Other examples of ammunition magazine loader/unloader devices and uses are still understood by one skilled in the art of ammunition handling and loading devices to be within the scope and spirit shown here.

Figure 1A:
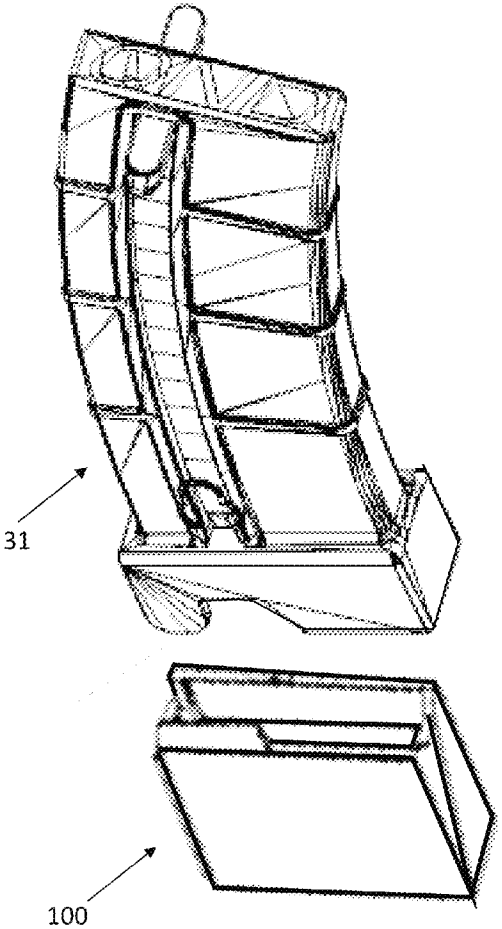

FIGS. 1 A and 1 B are sketches of the general magazine loader and magazine for holding ammunition device 30. Shown are the solid surface 31 general magazine loader device 30, an assembly 35 of general, magazine loader device 30 and magazine 100. Components and features are described in the following paragraphs.

Figures 2A, 2B, 2C, 2D, 2E, 2F, 2G, 2H, 2I, 2J:
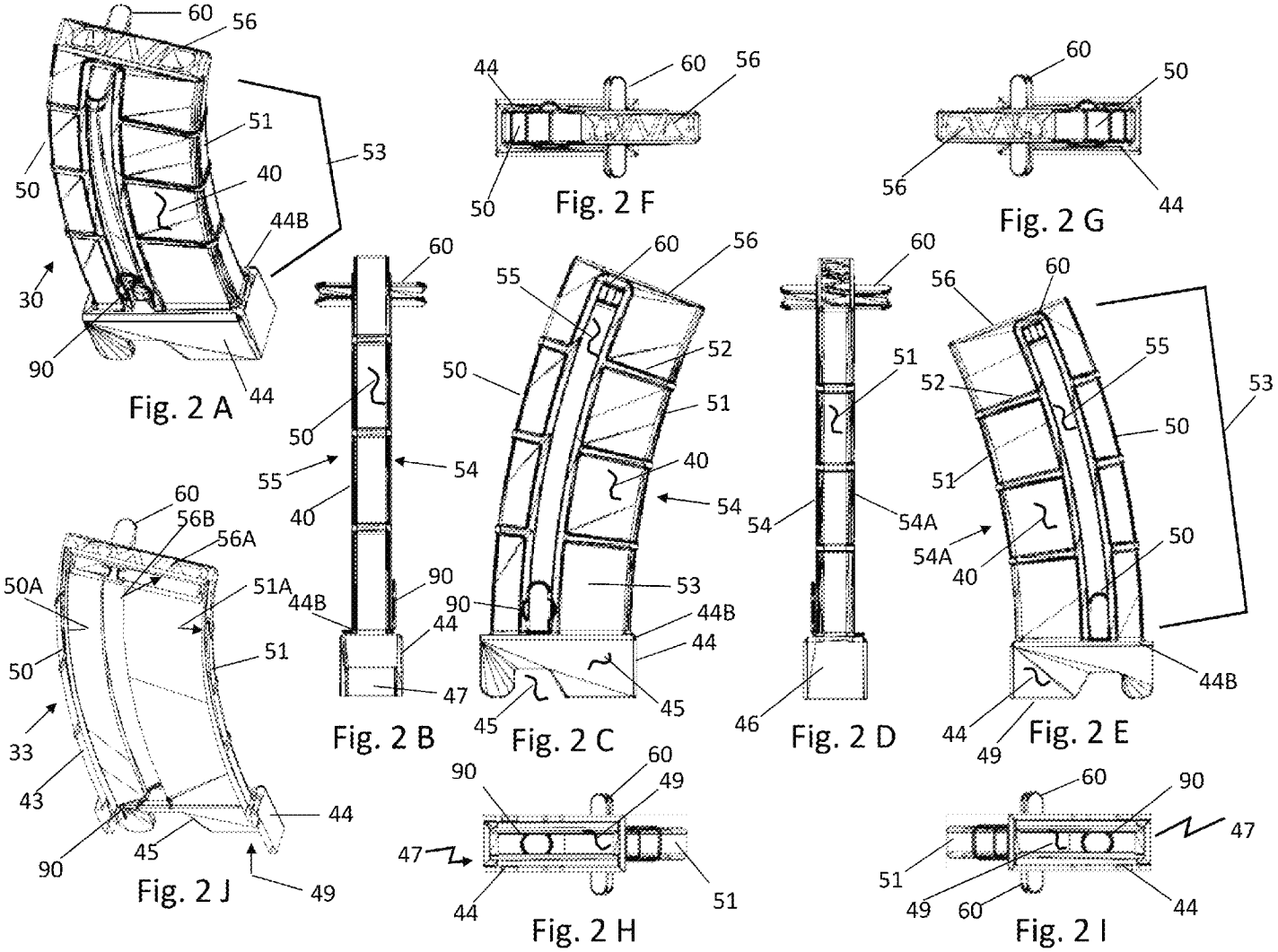
FIGS. 2 A through 2 J are line sketches of the general magazine loader device with components and features noted.

FIGS. 2 A through 2 J are line sketches of the general magazine loader device with components and features noted. Sketches here provide the components and assemblies as follows: a general ammunition storage and a magazine loading/unloading device 30 for weapons comprised of a loader body 40, plunger assembly 60 and retaining clip 90; a cross section 33 of general magazine loader device 30, 31; loader body 40 of magazine loader device 30,3 1; an inside surface 44A of magwell 44—essentially a rectangular opening for the magwell 44 to have a contiguous opening with the reservoir space 53A; a junction 44B of reservoir 53 and magwell 44; an aperture/slot/opening 45 in magwell 44 to accept magazine 100, 101; a solid end 46 of magwell 44; an ejection opening 47 opposite to solid end 46 in magwell 44; a bottom opening 49 of an essentially rectangular magwell 44; a convex end outer surface 50 of loader body 40, 41; a convex end inner surface 50A of loader body 40, 41; a concave end outer surface 51 of loader body 40, 41; a concave end inner surface 51A of loader body 40, 41; a group of structural ribs 52 for strengthening loader body 40, 41; a reservoir section 53 of loader body 40 left side 53 of loader body 40, 41 with aperture 55; an inner space 53A of reservoir section 53 for accepting ammunition 120—essentially a rectangular space surrounded by the sides and ends of the reservoir 53 permitting the ammunition 120 to be stored or to pass through the reservoir into the magwell section 44; a right side 54 of loader body 40, 41 with aperture 55; and a left side 54A of loader body 40, 41 with aperture 55; the aperture/slot/opening 55 for plunger assembly 60 handle 70; a top 56 of loader body 40; an outer surface 56A of top 56 of loader body 40; an inner surface 56B of top 56 of loader body 40; a plunger assembly 60 with block 65 and handle 70; and a spring retaining clip 90 or equal.

Figures 3A, 3B, 3C, 3D, 3E, 3F, 3G, 3H, 3I, 3J:
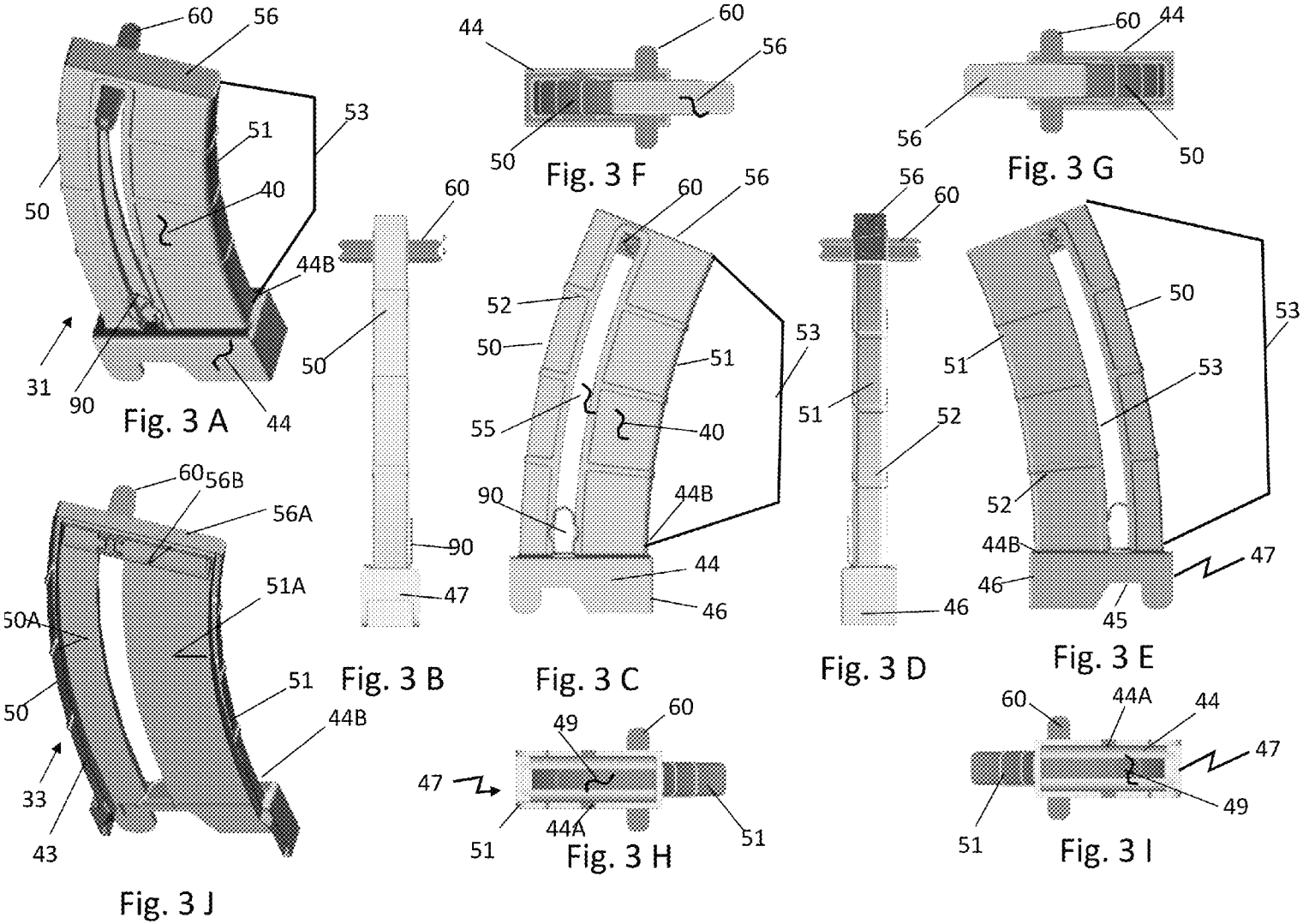
FIGS. 3 A through 3 J are solid sketches of the general magazine loader with the components and features shown from various views.

FIGS. 3 A through 3 J are solid sketches of the general magazine loader 30 with the components and features shown from various views. Also FIGS. 5 A through 5 J are line sketches of the loader body 40 of the general magazine loader 30 from various views. And finally, FIGS. 6 A through 6 J are solid line sketches of the loader body 40 of the general magazine loader 30. In all three sets if these Figure series 3, 5 and 6, the components are similarly shown as in the series 2 shown above. These show, for emphasis: a general ammunition storage and a magazine loading/unloading device 30 for weapons comprised of a loader body 40, plunger assembly 60 and retaining clip 90; a solid surface 31 general magazine loader device 30; a cross section 33 of general magazine loader device 30, 31; an assembly 35 of general, magazine loader device 30 and magazine 100; a loader body 40 of magazine loader device 30, 31; a solid sketch 41 of loader body 40; a cross section 43 of loader body 40 magwell 44/Non-Provisional magazine 100 interlocking or match up section of loader body 40; an inside surface 44A of magwell 44—essentially a rectangular opening for the magwell 44 to have a contiguous opening with the reservoir space 53A; a junction 44B of reservoir 53 and magwell 44; an aperture/slot/opening 45 in magwell 44 to accept magazine 100, 101; a solid end 46 of magwell 44; an outer surface 46A of solid end 46; an inner surface 46B of solid end 46; an ejection opening 47 opposite to solid end 46 in magwell 44; a pair of sides 48 of magwell 44 each with opposite slots 45; a bottom opening 49 of an essentially rectangular magwell 44; a convex end outer surface 50 of loader body 40, 41; a convex end inner surface 50A of loader body 40, 41; a concave end outer surface 51 of loader body 40, 41; a concave end inner surface 51A of loader body 40, 41; a group of structural ribs 52 for strengthening loader body 40, 41; a reservoir section 53 of loader body 40 left side 53 of loader body 40, 41 with aperture 55; an inner space 53A of reservoir section 53 for accepting ammunition 120 —essentially a rectangular space surrounded by the sides and ends of the reservoir 53 permitting the ammunition 120 to be stored or to pass through the reservoir into the magwell section 44; a right side 54 of loader body 40, 41 with aperture 55; and a left side 54A of loader body 40, 41 with aperture 55; the aperture/slot/opening 55 for plunger assembly 60 handle 70; a top 56 of loader body 40; an outer surface 56A of top 56 of loader body 40; an inner surface 56B of top 56 of loader body 40; a plunger assembly 60 with block 65 and handle 70; and a spring retaining clip 90 or equal.

Figures 4A, 4B, 4C, 4D, 4E, 4F, 4G, 4H, 4I:
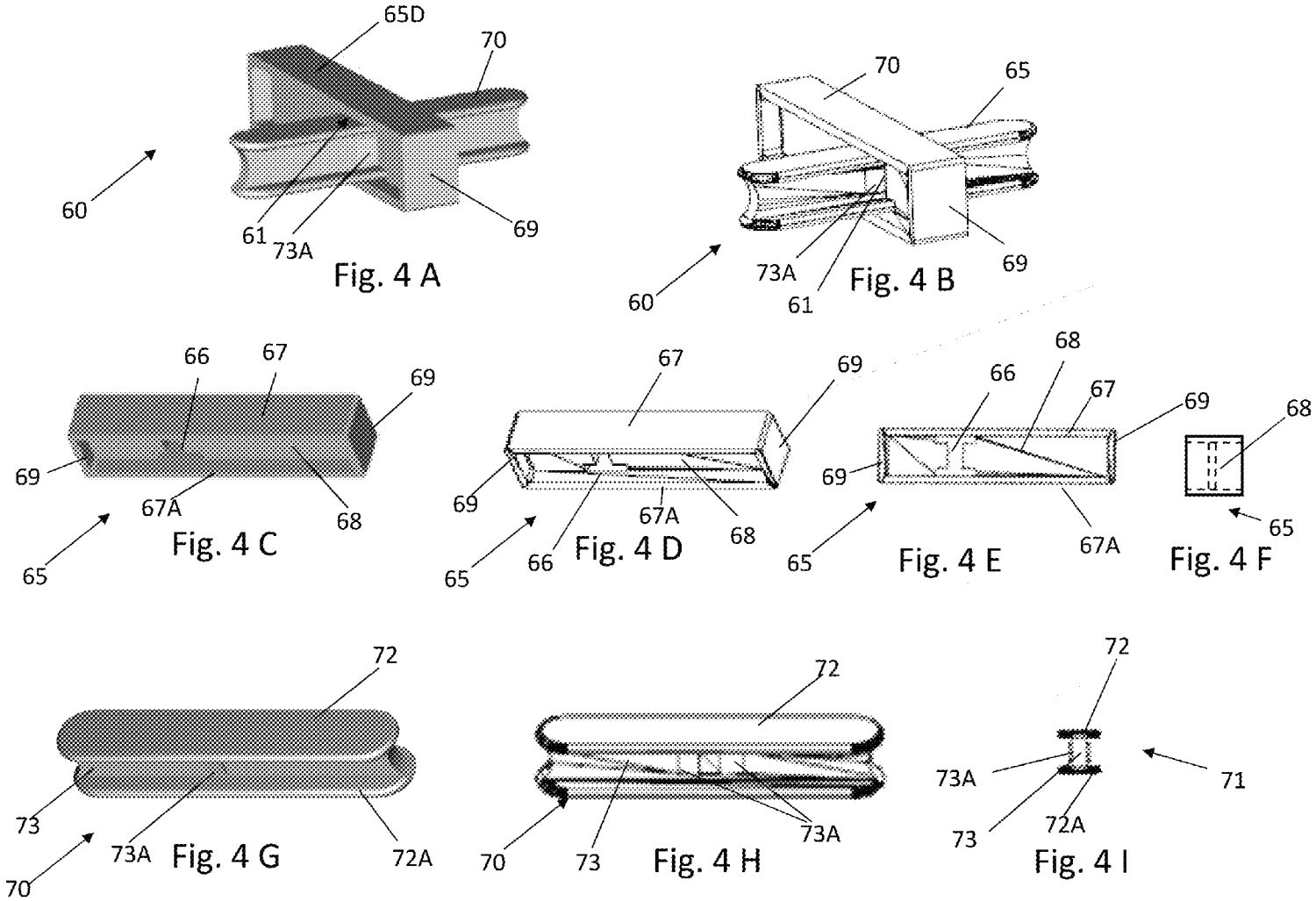
FIGS. 4 A and 4 B are isometric sketches of the plunger assembly.
Figures 5A, 5B, 5C, 5D, 5E, 5F, 5G, 5H, 5I, 5J:
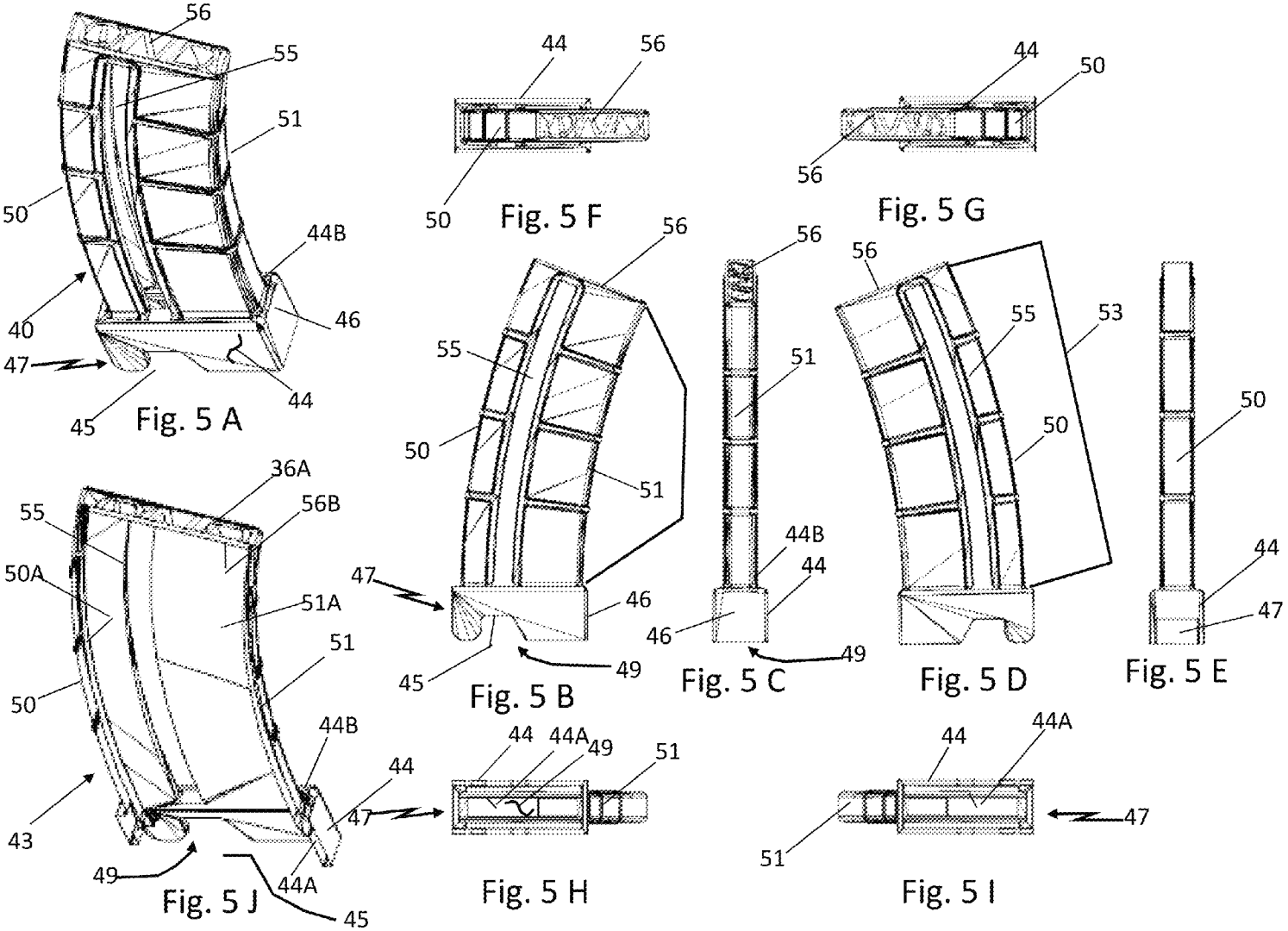
FIGS. 5 A through 5 J are line sketches of the loader body of the general magazine loader from various views.
Figures 6A, 6B, 6C, 6D, 6E, 6F, 6G, 6H, 6I, 6J:
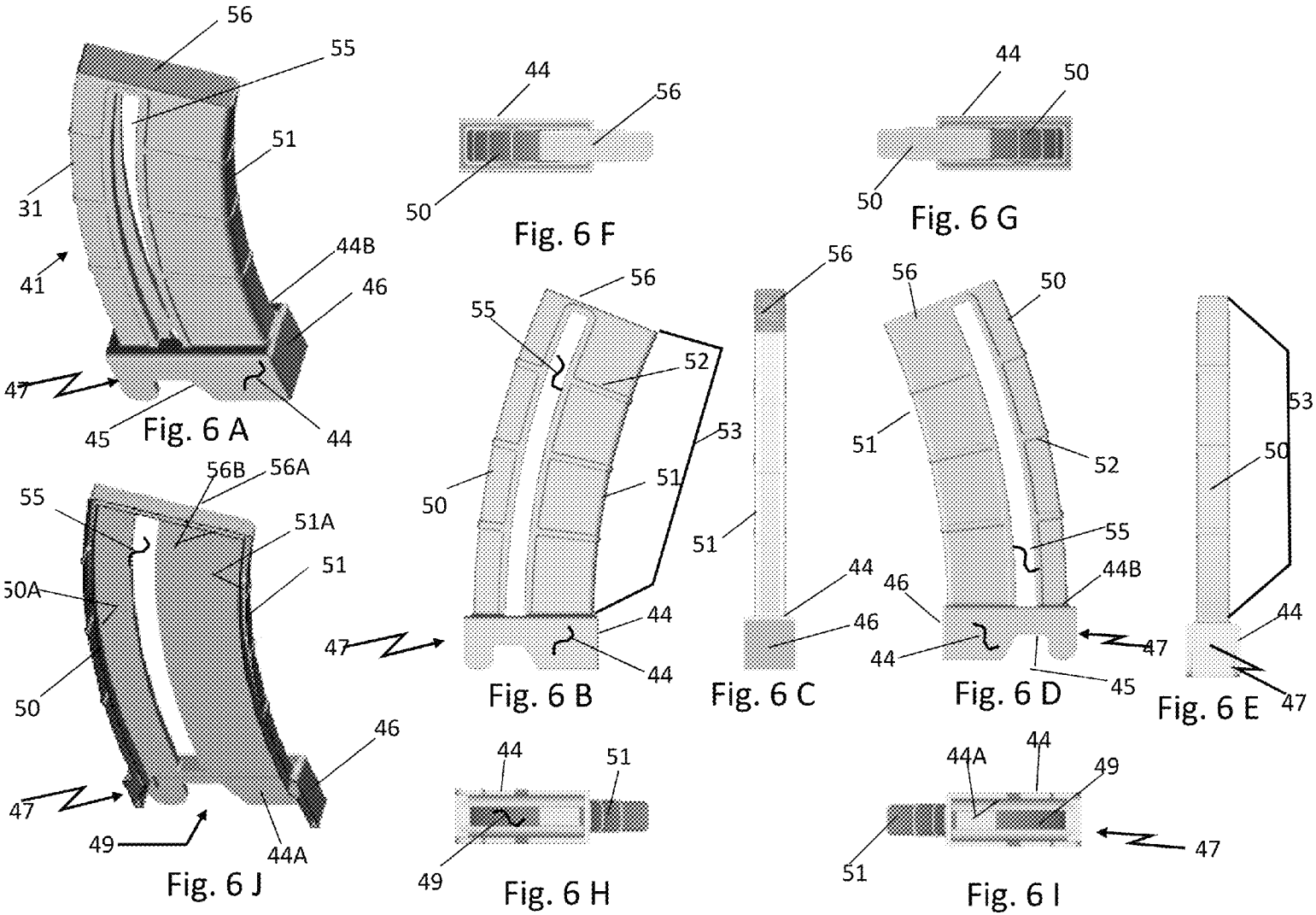
FIGS. 6 A through 6 J are solid line sketches of the loader body of the general magazine loader.

FIGS. 4 A and 4 B are isometric sketches of the plunger assembly. FIGS. 4 C through 4 F are sketches of the plunger block. FIGS. 4 G though 4 I are sketches of the plunger handle. Component parts and features demonstrate here include: a plunger assembly 60 with block 65 and handle 70; an engagement point 61 where handle 70 intersects block 65 at aperture 66; a plunger block 65 of plunger assembly 60; an opening/aperture 66 for handle 70; a top surface 67 of block 65; a bottom surface 67A of block 65; a web 68 of block 65 a pair of end surfaces 69 of block 65; a plunger handle 70 of plunger assembly 60; a cross section 71 "I" or equal; a top surface 72 of "I" 71; a bottom surface 72A of "I" 71; a web 73 of handle 70; and locking tabs 73A on web 73 of plunger handle 70.

Figures 7A, 7B, 7C, 7D, 7E, 7F:
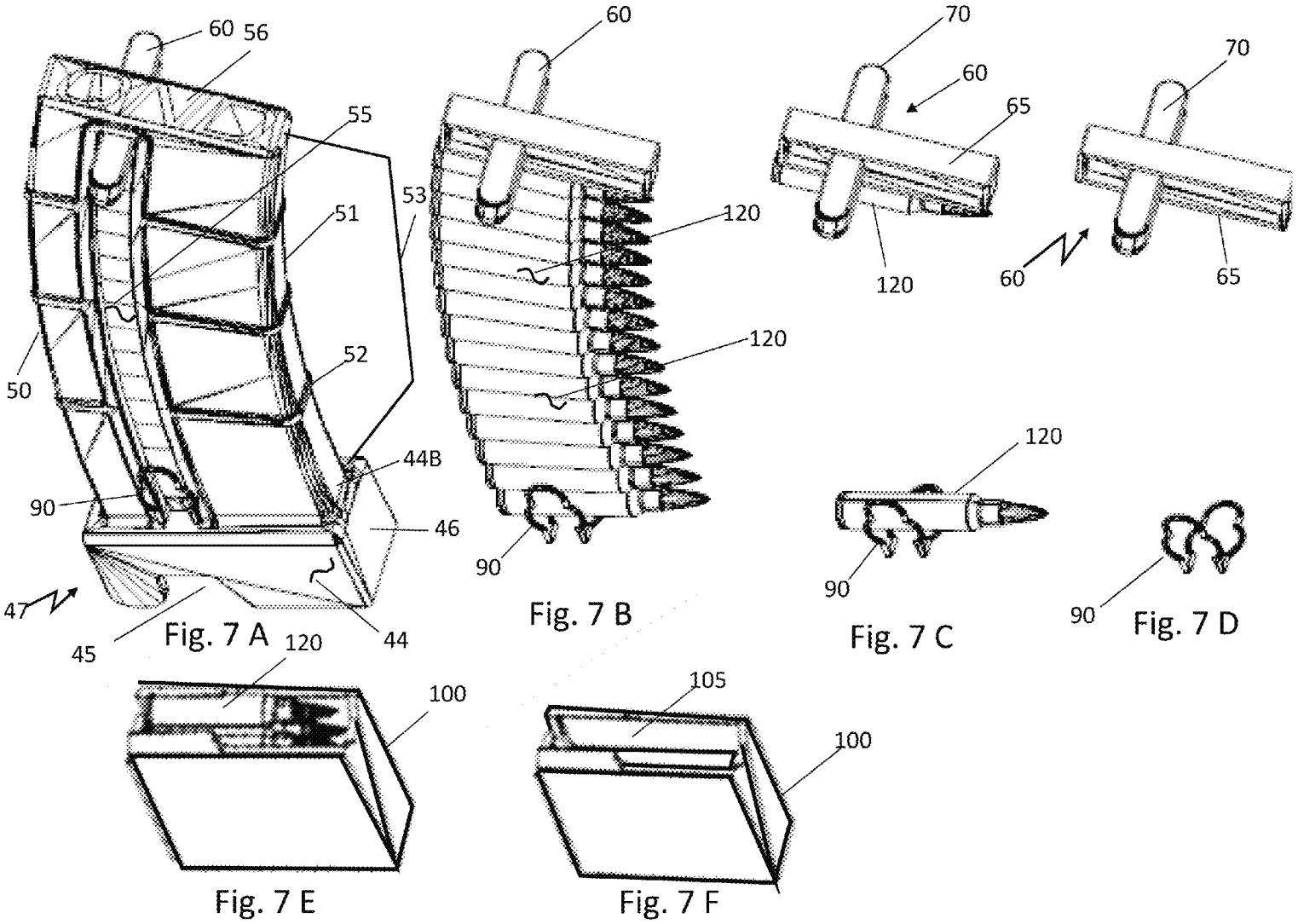
FIGS. 7 A through 7 D are assemblies and sub-assemblies and components for the general magazine loader.

FIGS. 7 A through 7 D are assemblies and sub-assemblies and components for the general magazine loader. FIGS. 7 E and 7 F are typical magazines. Shown in these sketches are a magwell 44/magazine 100 interlocking or match up section of loader body 40; a junction 44B of reservoir 53 and magwell 44; an aperture/slot/opening 45 in magwell 44 to accept magazine 100,101; a solid end 46 of magwell 44; an ejection opening 47 opposite to solid end 46 in magwell 44; a convex end outer surface 50 of loader body 40,41; a concave end outer surface 51 of loader body 40,41; a group of structural ribs 52 for strengthening loader body 40,41; a reservoir section 53 of loader body 40; a top 56 of loader body 40; a plunger assembly 60 with block 65 and handle 70; the plunger block 65 of plunger assembly 60; the plunger handle 70 of plunger assembly 60; a spring retaining clip 90 or equal; a magazine 100 line sketch; a top opening 105 of magazine 100; and at least one round 120 of ammunition.

Figures 8A, 8B, 8C, 8D, 8E, 8F, 8G:
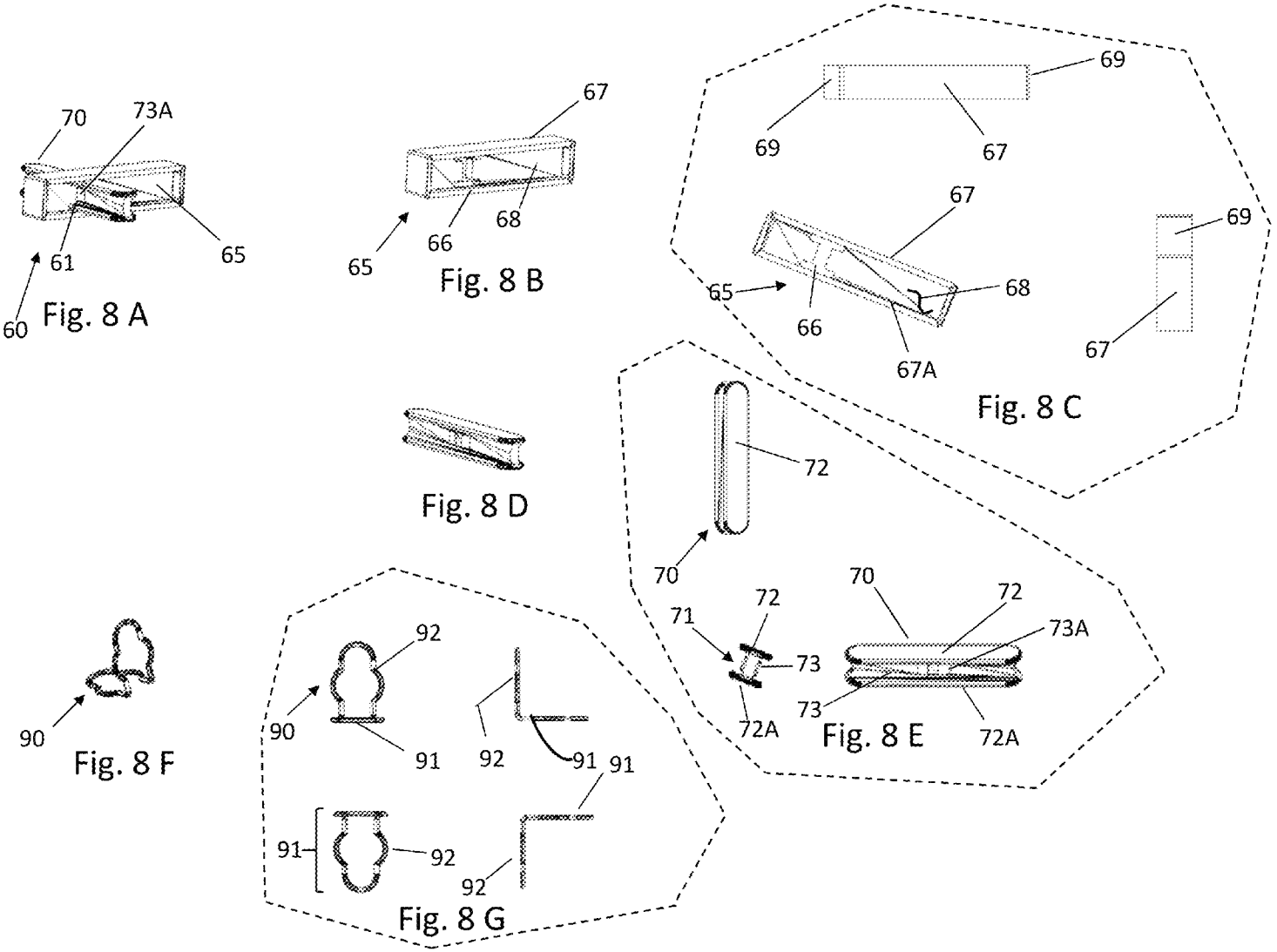
FIGS. 8 A through 8 G are component sketches the plunger assembly, plunger block, plunger handle and retaining clip.

FIGS. 8 A through 8 G are component sketches the plunger assembly, plunger block, plunger handle and retaining clip. Parts, components and features shown here include: a plunger assembly 60 with block 65 and handle 70; an engagement point 61 where handle 70 intersects block 65 at aperture 66; a plunger block 65 of plunger assembly 60; an opening/aperture 66 for handle 70; a top surface 67 of block 65; a bottom surface 67A of block 65; a web 68 of block 65 a pair of end surfaces 69 of block 65; a plunger handle 70 of plunger assembly 60; a cross section 71 "I" or equal; a top surface 72 of "I" 71; a bottom surface 72A of "I" 71; a web 73 of handle 70; a set of locking tabs 73A on web 73 of plunger handle 70; a spring retaining clip 90 or equal; an essentially horizontal engagement protrusion 91 of clip 90; an essentially vertical handle 92 of clip 90; and a spring configuration 93 of clip 90 (inter connected arches, squares or the like of a wire or strip (metal, plastic, composite or the like).

Figures 9A, 9B, 9C, 9D, 9E, 9F, 9G, 9H, 9I, 9J, 9K, 9L, 9M:
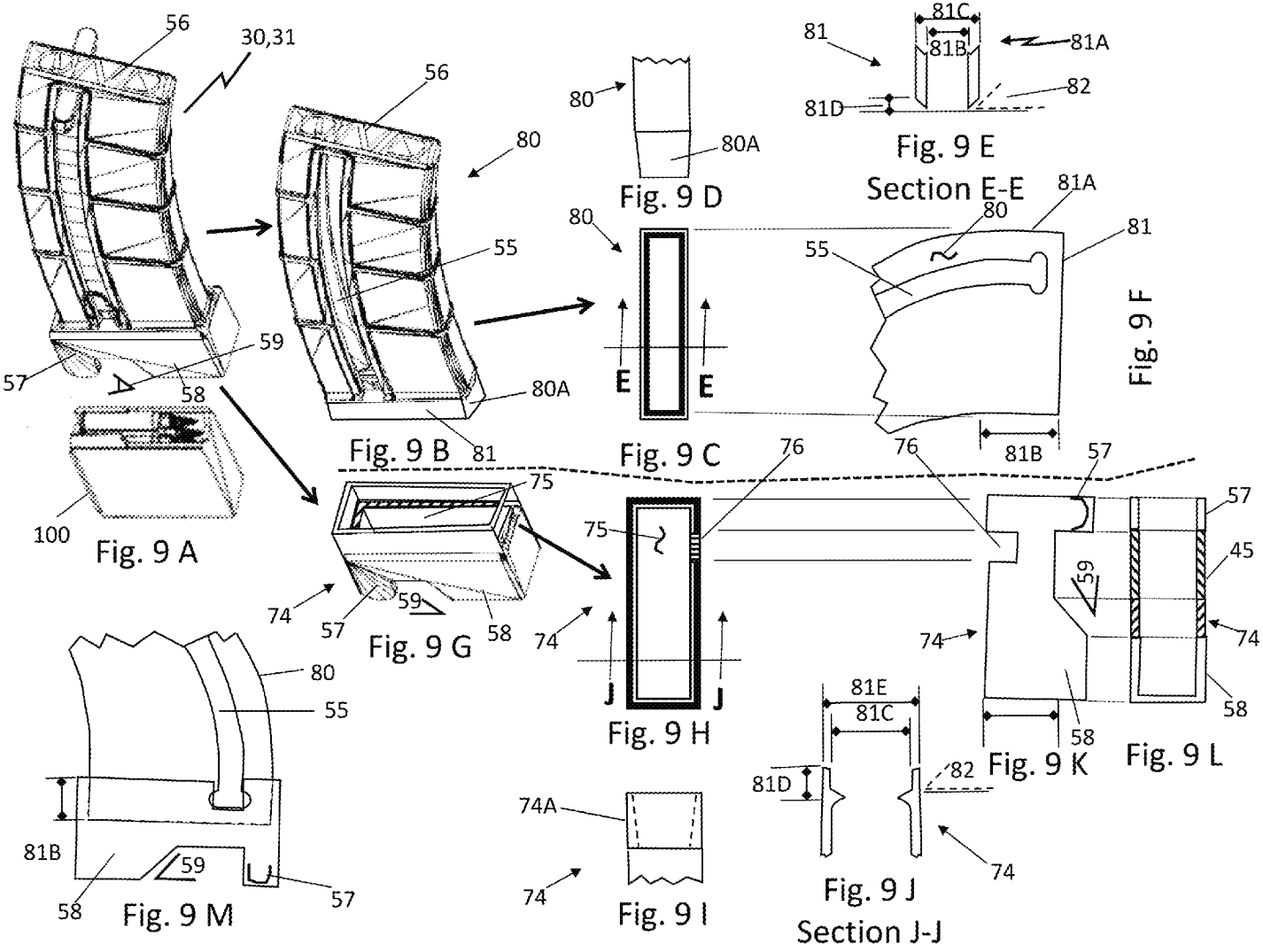
FIGS. 9 A through 9 M are sketches of an alternative embodiment of the magazine loader with components and mating cross sections shown.

FIGS. 9 A through 9 M are sketches of an alternative embodiment of the magazine loader with components and mating cross sections shown. This alternative essentially splits the loader body 40 into a separate reservoir 80 and a separate magwell collar 74. The sketches for these demonstrate: a general ammunition storage and a magazine loading/unloading device 30 for weapons comprised of a loader body 40, plunger assembly 60 and retaining clip 90; a solid surface 31 general magazine loader device 30; the aperture/slot/opening 45 in magwell 44 to accept magazine 100, 101; an aperture/slot/opening 55 for plunger assembly 60 of the handle 70 and block 65; a top 56 of loader body 40 or the separate reservoir 80; a rim end 57 magwell 44 and extension 74; a projectile end 58 of the magwell 44 or magwell extension 74; an angle 59 of magwell rim approximately 30 degrees from the end of the magwell 44, 74; a magwell collar or extension 74; a taper 74A of magwell collar or extension 74; an inside surface 74B of magwell collar 74—essentially a rectangular opening for the magwell collar 74 to have a contiguous opening with the separate reservoir space 80B; a joint aperture 75 with separate reservoir 80; a notch 76 for magwell collar 74; separate reservoir 80; an end taper 80A of reservoir 80 inner space 80B of separate reservoir 80 for accepting ammunition 120—essentially a rectangular space surrounded by the sides and ends of the separate reservoir 80 permitting the ammunition 120 to be stored or to pass through the separate reservoir 80 into the magwell collar 74; a bottom 81 of reservoir 80; a bottom taper 81A of separate reservoir 80; a side of taper 81B; an outside width 81C of reservoir 80; an engagement taper 81D of separate reservoir 80; outside width dimension 81E of magwell collar or extension 74; a mating angle 82 approximately 45 degrees; and the magazine 100 line sketch.

Figures 10A, 10B, 10C, 10D, 10E, 10F:
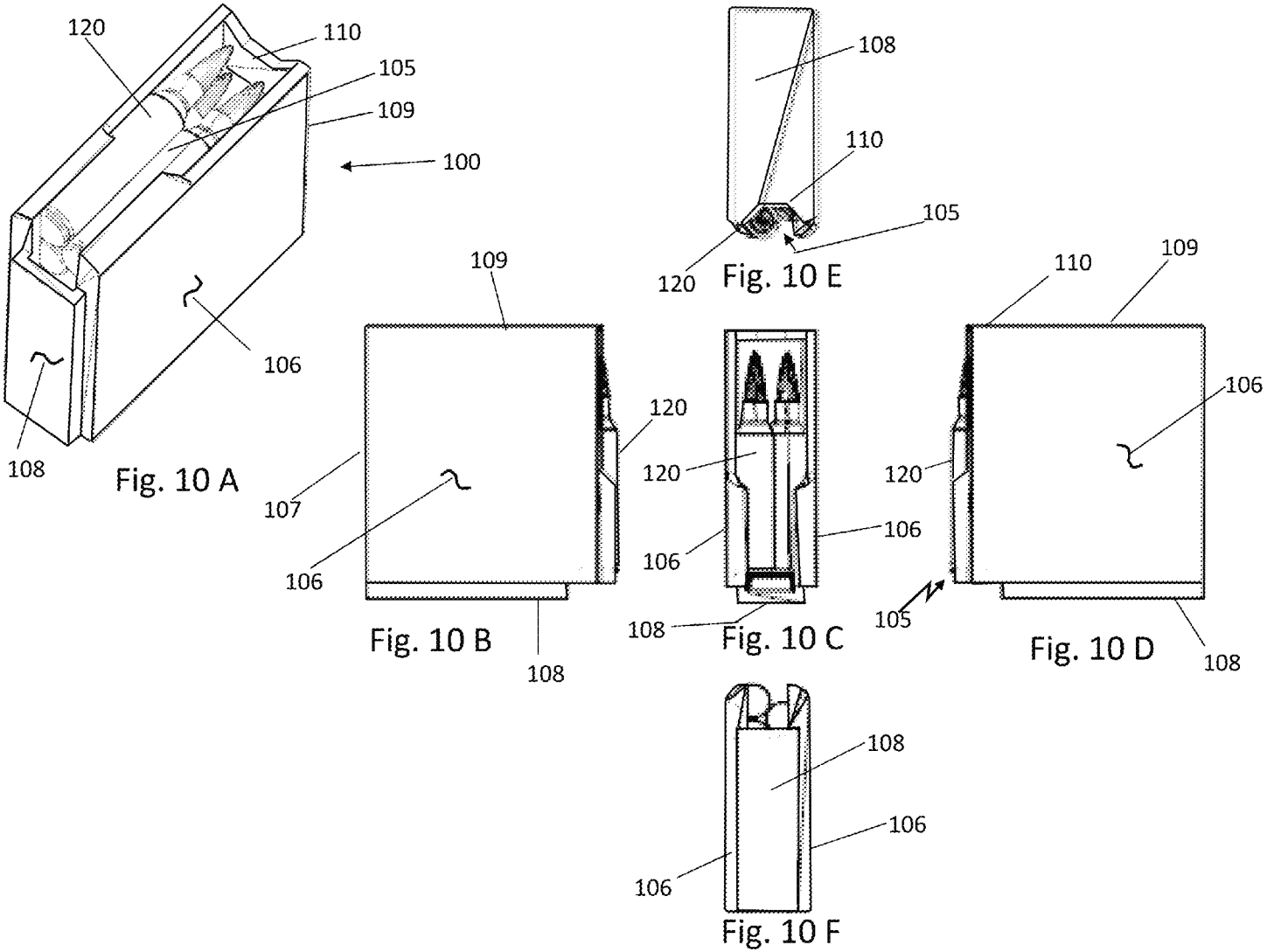
FIGS. 10 A through 10 F are sketches of magazines from various views.

FIGS. 10 A through 10 F are sketches of magazines from various views. Here are shown: a magazine 100 line sketch; a solid surface 101 magazine 100; a top opening 105 of magazine 100; a left and right hand sides 106 of magazine 100 bottom 107 of magazine 100; a rim end 108 of magazine 100; a projectile end 109 of magazine 100; an aperture/clearance/Non-Provisional slot 110 for ammunition 120 to exit magazine 100; and a round 120 of ammunition.

Figures 11A, 11B, 11C, 11D, 11E, 11F, 11G, 11H, 11I, 11J:
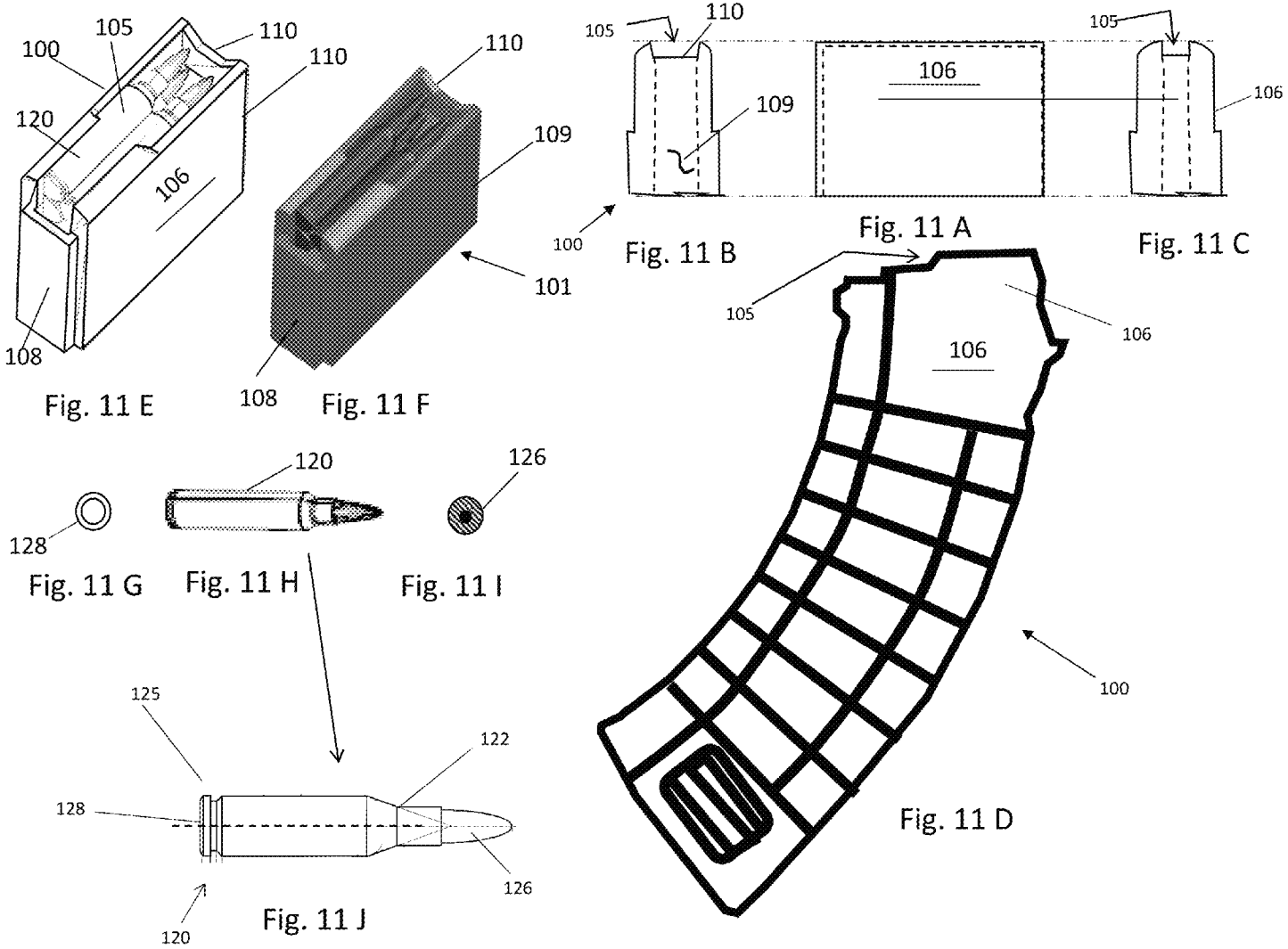
FIGS. 11 A through 11 F are additional sketches of a typical ammunition magazine.

FIGS. 11 A through 11 F are additional sketches of a typical ammunition magazine. FIG. 11 G through 11 J are sketches of a typical rifle round of ammunition, as an illustration. Here are portrayed a magazine 100 line sketch; a solid surface 101 magazine 100; a top opening 105 of magazine 100; a left and right hand sides 106 of magazine 100 bottom 107 of magazine 100; a rim end 108 of magazine 100; a projectile end 109 of magazine 100; an aperture/clearance/slot 110 for ammunition 120 to exit magazine 100; a round 120 of ammunition; a projectile 122 and rim ridge 125 for reference; a rim groove 128 of ammunition 120; and a projectile (end) 126 of ammunition 120. The actual size and caliber is not a limitation, only an example. One skilled in the art of firearms and ammunition realizes well that the innovation shown within this new magazine ammunition loader 31 an unloader 35 may be adapted for other various sized ammunition cartridges and magazines.

Figure 12C:
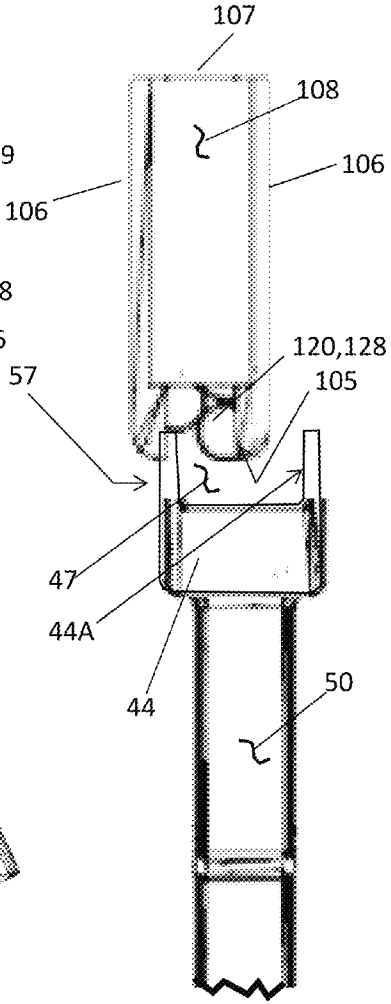
FIGS. 12 A through 12 C are operational sketches of how to use the magazine loader device as an unloading mechanism.
Figure 12B:
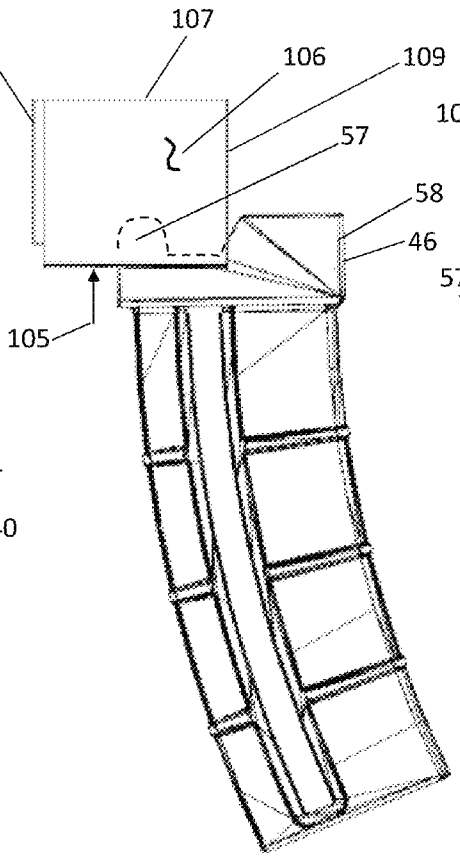
Figure 12A:
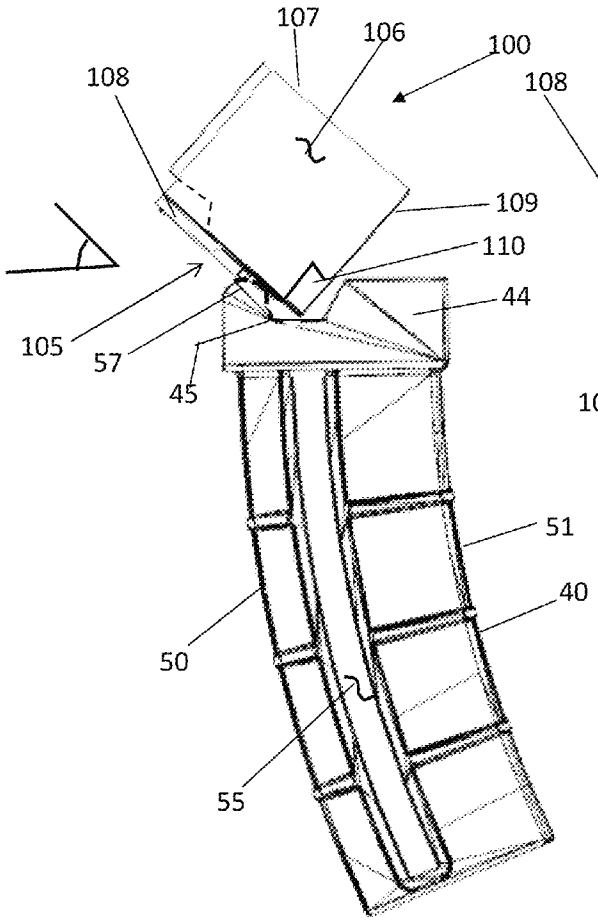

FIGS. 12 A through 12 C are operational sketches of how to use the magazine loader device as an unloading mechanism. These are discussed in the below Operation section.

The components of the ammunition storage and a magazine loading/unloading device may be comprised of heavy duty, durable plastic or composite material. They may also be made of a metal such as steel, steel alloy, or aluminum and may be coated with a powder coat, paint, plating, galvanizing/zinc coating or other surface finish. In addition the plunger handle 70 and plunger block 65 may be comprised of heavy duty, durable plastic or composite material. They may also be made of a thin, lightweight metal such as [for example and not as a limitation] steel, steel alloy, tin and aluminum and may be coated with a powder coat, paint, plating, galvanizing/zinc coating, or other surface finish.

The details mentioned here are exemplary and not limiting. Other specific components and manners specific to describing an ammunition loader 31 may be added as a person having ordinary skill in the field of ammunition handling and loading devices and their uses well appreciates.

Operation of the Embodiments

The ammunition storage and magazine loading/unloading device for weapons 30 have been described in the above embodiment. The manner of how this device operates is described below. One notes well that the description above and the operation described here must be taken together to fully illustrate the concept of the ammunition storage and a magazine loading/unloading device 30 for weapons. The concept embodiment of the device and the alternative embodiment with a separate reservoir 80 and a separate magwell 74 are described above.

The manner of operation anticipates that the actual size and caliber is not a limitation, only an example. One skilled in the art of firearms and ammunition realizes well that the innovation shown within this new magazine ammunition loader device 30 and the concept of the alternative ammunition loaders may be adapted for other various sized ammunition cartridges and magazines. The ammunition storage and magazine loading/unloading device for weapons 30 is pre-loaded with the cartridges 120. The ammunition rounds 120 are held in the reservoir or loader body by the retaining clip 90. These rounds 120 may be gravity fed for the standard loading device 30, 31. Next the loader 30 is mated with the magazine 100 at the magwell 44, 74 by simply pushing the magazine into the magwell 44, 74. This is shown in FIGS. 1 and 12. The magazine 100 is held by the user (person). Now, the retaining clip 90 is removed. Next, the plunger block and handle 60 (with the person/user grasping the handle 65) is forced toward the magazine 100. As the ammunition 120 feeds into the magazine 100, the handle 65 moves toward the magazine. When the plunger assembly 60 bottoms out on the bottom end of the slot 55, all the reserve ammunition 120 has been expended from the device 30, through the magwell 44, 74, and into the magazine 90. While the ammunition storage and magazine loading/unloading device for weapons 30 is in a storage mode, ammunition may be held inside by using the retaining clip 90

The alternative embodiment of the ammunition storage and magazine loading/unloading device for weapons 30 operates in a similar manner except the separate magwell 74 and separate reservoir need to be assembled prior to loading. One notes that the reservoir 80 may be used separately with the retaining clip 90 as a storage device and then mated to the magwell collar 74 when ready to load the rounds 120 into the magazine 100.

FIGS. 12 A through 12 C are operational sketches of how to use the magazine loader device as an unloading mechanism. Here are shown the following: loader body 40 of magazine loader device 30, 31; a magwell 44/magazine 100 interlocking or match up section of loader body 40; an aperture/slot/opening 45 in magwell 44 to accept magazine 100, 101; a solid end 46 of magwell 44; an ejection opening 47 opposite to solid end 46 in magwell 44; a convex end outer surface 50 of loader body 40, 41; a concave end outer surface 51 of loader body 40, 41; an aperture/slot/opening 55 for plunger assembly 60 handle 70; a rim end 57 magwell 44 and extension 74; a projectile end 58 magwell 44 and extension 74; a magazine 100 line sketch; a top opening 105 of magazine 100; a left and right hand sides 106 of magazine 100; a bottom 107 of magazine 100; a rim end 108 of magazine 100; a projectile end 109 of magazine 100; a aperture/clearance/slot 110 for ammunition 120 to exit magazine 100; a round 120 of ammunition; and a rim groove 128 end 125 of ammunition 120. Essentially, the loader body 40 is inverted and held with the opening pointed upwards at about an engagement angle $\alpha$ of approximately 15 to 30 degrees to horizontal. Then the magazine 100 is held with the rounds 120 toward the ground or downward. The rim end 125 of the magazine 100 is situated over the rim end 57 directly over the ejection opening 47 opposite to solid end 46 in magwell 44, 74 at about an engagement angle $\alpha$ of approximately 15 to 30 degrees. This rim end 57 makes contact with a first and a second rounds 120 which being forced to the top/open end 105 of the magazine 100 with the spring of the magazine 100. It is important to note that the end 57 of the magwell essentially is contacting theses rounds at their interface. The magazine 100 is then rotated "R" from a downward angle against the magwell 44 rim end 57 and then the magazine 100 is continued to be rotated until the top opening 105 of magazine 100 is contiguous to the magwell 44, 74. The rounds 120 then begin to be released. The magazine 100 is then reverse rotated to permit the end 57 to allow the first round to drop and the second round to advance. Then the magazine 100 is again rotated to the intersection of the second round and the newly advanced third round. This back and forth rotation may be repeated for each set of rounds until the magazine is emptied. Note that each time the magazine 100 is repeatedly rotated back and forth and the rounds 120 fall into the inner space 53A, 80B of the loader body 40 or reservoir 80.

With this description it is to be understood that the ammunition storage and a magazine loading/unloading device for weapons are not to be limited to only the disclosed embodiment of product. The features of the device are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

What is claimed is:

1. An ammunition storage and a magazine loading/unloading device for weapons and made of durable materials comprised of:

a) a loader body having a reservoir section featuring an essentially rectangular inner space for receiving a series of ammunition rounds, the reservoir section further having a pair of opposing slots, the loader body further having a magwell section with an inner space and a connecting means configured to receive an ammunition magazine therein, and having a means for connecting the magwell section to the reservoir section;

b) an essentially rectangular block which slidably interfaces with the essentially rectangular inner space of the reservoir section, the rectangular block having an aperture receiving a plunger handle;

c) the plunger handle having a cross section configured and sized to removably fit into the aperture of the rectangular block and extend into the opposing slots of the reservoir section; and d) a spring retaining clip interposed into the pair of slots of the loader body to hold the ammunition in the inner space of the loader body wherein the ammunition storage and a magazine loading/unloading device provides a simple means for storing, loading and unloading ammunition from a magazine and wherein the device may retain at least one cartridge which may be forced into a magazine from the loader body so an operator can quickly and efficiently reload a cartridge into a receiving magazine.

2. The ammunition storage and a magazine loading/unloading device in claim 1 wherein the durable materials used is from a group consisting of heavy duty, durable plastic and composite material.

3. The ammunition storage and a magazine loading/unloading device described in claim 1 wherein the durable materials used is from a group consisting of a metal, a steel, a steel alloy, aluminum, tin and a metal with a surface finish.

4. The group described in claim 3 wherein the durable material has a surface finish that is from a group consisting of a powder coat, paint, plating and galvanizing/zinc coating.

5. The ammunition storage and a magazine loading/unloading device described in claim 1 wherein the reservoir section is further comprised of a solid top, a left and a right side with the slots, a convex end with an inner and outer surface, a concave end with an inner and outer surface, and an opening opposite the solid top contiguous to the magwell section.

6. An ammunition storage and a magazine loading/unloading device for weapons and made of durable plastic comprised of:

a) a loader body having a reservoir section featuring an essentially rectangular inner space for receiving a series of ammunition rounds, the reservoir section further having a pair of opposing slots and further the reservoir section is comprised of a solid top, a left and a right side each side having one of the opposing slots, a convex end with an inner and outer surface, a concave end with an inner and outer surface, and an opening opposite the solid top, the loader body further having a magwell section with an inner space and a connecting means configured to receive an ammunition magazine therein, and having a means for connecting the magwell section to the reservoir section;

b) an essentially rectangular block which slidably interfaces with the essentially rectangular inner space of the reservoir section the rectangular block having an aperture receiving a plunger handle;

c) the plunger handle having a cross section configured and sized to removably fit into the aperture of the rectangular block and into the opposing slots of the reservoir section; and d) a spring retaining clip interposed into the pair of slots of the loader body to hold the ammunition in the inner space of the loader body wherein the ammunition storage and a magazine loading/unloading device provides a simple means for storing, loading and unloading ammunition from a magazine and wherein the device may retain at least one cartridge which may be forced into a magazine from the loader body so an operator can quickly and efficiently reload a cartridge into a receiving magazine.

7. An ammunition storage and a magazine loading/unloading device for weapons and made of durable materials comprised of:

a) a separate reservoir section featuring an essentially rectangular inner space for receiving a series of ammunition rounds and the reservoir section further having a pair of opposing slots;

b) a separate magwell section with an inner space and a connecting means configured to receive an ammunition magazine therein;

c) a means for attaching the magwell section to the reservoir section;

d) an essentially rectangular block which slidably interfaces with the essentially rectangular inner space of the reservoir section the rectangular block having an aperture receiving a plunger handle;

e) the plunger handle cross section to configured and sized to removably fit into the aperture of the rectangular block and into the opposing slots of the reservoir section; and f) a spring retaining clip interposed into the pair of slots of the loader body to hold the ammunition in the inner space of the loader body wherein the ammunition storage and a magazine loading/unloading device provides a simple means for storing, loading and unloading ammunition from a magazine and wherein the device may retain at least one cartridge which may be forced into a magazine from the loader body so an operator can quickly and efficiently reload a cartridge into a receiving magazine.

8. The ammunition storage and a magazine loading/unloading device in claim 7 wherein the durable materials used is from a group consisting of heavy duty, durable plastic and composite material.

9. The ammunition storage and a magazine loading/unloading device described in claim 7 wherein the durable materials used is from a group consisting of a metal, a steel, a steel ahoy, aluminum, tin and a metal with a surface finish.

10. The group described in claim 9 wherein the durable material has a surface finish that is from a group consisting of a powder coat, paint, plating and galvanizing/zinc coating.

* * * * *